US008171748B2

(12) United States Patent
Ooishi et al.

(10) Patent No.: US 8,171,748 B2
(45) Date of Patent: May 8, 2012

(54) INDOOR UNIT OF AIR CONDITIONER

(75) Inventors: Kazuhiro Ooishi, Tokyo (JP); Yoshiyuki Nakagawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 958 days.

(21) Appl. No.: 12/178,166

(22) Filed: Jul. 23, 2008

(65) Prior Publication Data

US 2009/0158765 A1 Jun. 25, 2009

(30) Foreign Application Priority Data

Dec. 25, 2007 (JP) ..... 2007-332792

(51) Int. Cl.
*F25D 23/12* (2006.01)
*F25D 19/00* (2006.01)

(52) U.S. Cl. ..... 62/263; 62/262; 62/298

(58) Field of Classification Search ..... 62/262, 62/263, 298
See application file for complete search history.

(56) References Cited

U.S. PATENT DOCUMENTS 4,292,815 A * 10/1981 Bolton ..... 62/262

FOREIGN PATENT DOCUMENTS

| | | |
|---|---|---|
| EP | 1 669 683 | 6/2006 |
| JP | 58-067217 U | 5/1983 |
| JP | 59-190519 U | 12/1984 |
| JP | 5-133541 A | 5/1993 |
| JP | 06-082072 | 3/1994 |
| JP | 6-249457 A | 9/1994 |
| JP | 07-112454 | 5/1995 |

(Continued)

OTHER PUBLICATIONS

Reasons for Rejection issued in corresponding Japanese Application No. 2007-332792 dated Nov. 17, 2009, and an English Translation thereof.
European Search Report issued in the corresponding Application No. 08253799.4-2301 dated Feb. 25, 2010.

(Continued)

*Primary Examiner* — Frantz Jules
*Assistant Examiner* — Daniel C Comings
(74) *Attorney, Agent, or Firm* — Posz Law Group, PLC

(57) ABSTRACT

It is an object of the present invention to provide an indoor unit of an air conditioner including a front opening and closing panel with a structure wherein a sink is difficult to occur in a design surface. The indoor unit of the air conditioner according to the present invention, the indoor unit of the air conditioner being a wall-hung type indoor unit, including a main body having a front frame of a main body and a back frame of a main body, a front opening and closing panel 1 that is mounted on the front frame of the main body in a freely openable and closable manner, an arm 25 that is provided on a rear surface of the front opening and closing panel 1 and held in a freely rotating manner at the front frame of the main body, a lug 26 that is provided on the rear surface of the front opening and closing panel 1 and latched to the front frame of the main body with the front opening and closing panel 1 being in a closed state, a base, whereon the arm 25 or the lug 26 is disposed upright, that is provided on the rear surface of the front opening and closing panel 1 in a manner spaced apart from the front opening and closing panel, and a thin-walled leg that links the front opening and closing panel 1 with the base.

18 Claims, 8 Drawing Sheets

FOREIGN PATENT DOCUMENTS

| | | | |
|---|---|---|---|
| JP | 11-166749 | A | 6/1999 |
| JP | 2001-065907 | A | 3/2001 |
| JP | 2005-147618 | | 6/2005 |
| JP | 2007-225253 | | 9/2007 |
| JP | 2007-245413 | | 9/2007 |

OTHER PUBLICATIONS

Examiner's First Report issued in the corresponding Australian Patent Application No. 2008203280 dated Mar. 11, 2010.

* cited by examiner

INDOOR UNIT OF AIR CONDITIONER

BACKGROUND OF THE INVENTION

1. Field of the Invention

The present invention relates to an indoor unit of an air conditioner, and particularly to a front opening and closing panel provided in an openable and closable manner at a front surface of a main body of the indoor unit.

2. Background Art

A conventional indoor unit of an air conditioner includes a front opening and closing panel as a design surface which is openable and closable. An air inlet to suction indoor air, etc. is not formed in the front opening and closing panel. The front opening and closing panel in the form of approximately rectangular shaped plate is fixed to a housing of the indoor unit. Arms for connecting the front opening and closing panel with the housing of the indoor unit in an openable and closable manner, and lugs for retaining a closed state of the front opening and closing panel against the housing of the indoor unit when the front opening and closing panel is closed are integrally formed with the front opening and closing panel on a rear surface of the front opening and closing panel.

The indoor unit of the air conditioner is generally lengthwise rectangular in a front view. The front opening and closing panel has approximately the same shape as the indoor unit of the air conditioner in a front view.

The arms for connecting the front opening and closing panel with the housing of the indoor unit in an openable and closable manner, and the lugs for retaining a closed state of the front opening and closing panel against the housing of the indoor unit when the front opening and closing panel is closed are generally provided in the vicinity of both right and left ends of the rear surface of the front opening and closing panel. The arms are provided in an upper part in the vicinity of both right and left ends of the rear surface of the front opening and closing panel, and the lugs are provided in a lower part in the vicinity of both right and left ends of the rear surface of the front opening and closing panel.

Patent literature 1: Japanese Unexamined Patent Publication No. 11-166749

Description of the Related Art

Since a conventional indoor unit of an air conditioner is configured as mentioned above, there is a problem that "sinks" are formed in a design surface (the surface that is exposed in a room when the front opening and closing panel is closed) of the front opening and closing panel.

"Sink" is a hollow in a surface of a resin molding product. This is formed mainly due to an inappropriately designed metallic die. It is a phenomenon that a hollow is formed in a surface due to shrinkage of a resin when thickness of a resin molding product is uneven, or when a thick rib or a thick boss exists on the under side of the resin molding product. Sinks are likely to occur in a part apart from a resin inlet of the metal die since the fill pressure of the resin is low.

The arms for connecting the front opening and closing panel with the housing of the indoor unit in an openable and closable manner correspond to the thick bosses. Further, since the arms are provided in the vicinity of both right and left ends of the rear surface of the front opening and closing panel, they are apart from the resin inlet of the metal die formed in the vicinity of a center of the front opening and closing panel. Therefore, sinks are likely to occur in the design surface in the vicinity of the arms.

SUMMARY OF THE INVENTION

The present invention is aimed at resolving the above-mentioned problem, and providing an indoor unit of an air conditioner including a front opening and closing panel having such a structure that sinks are difficult to occur in a design surface.

An indoor unit of an air conditioner according to the present invention, the indoor unit of the air conditioner being a wall-hung type indoor unit, including: a main body having a front frame of a main body and a back frame of a main body; a front opening and closing panel that is mounted on the front frame of the main body in a freely openable and closable manner; an arm that is provided on a rear surface of the front opening and closing panel, and held in a freely rotating manner at the front frame of the main body; a lug that is provided on the rear surface of the front opening and closing panel, and latched to the front frame of the main body when the front opening and closing panel is in a closed state; a base, whereon the arm or the lug is disposed upright, that is provided on the rear surface of the front opening and closing panel in a maimer spaced apart from the front opening and closing panel; and a leg small in thickness that links the front opening and closing panel with the base.

BRIEF DESCRIPTION OF THE DRAWINGS

A complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Embodiment 1

Figure 1:
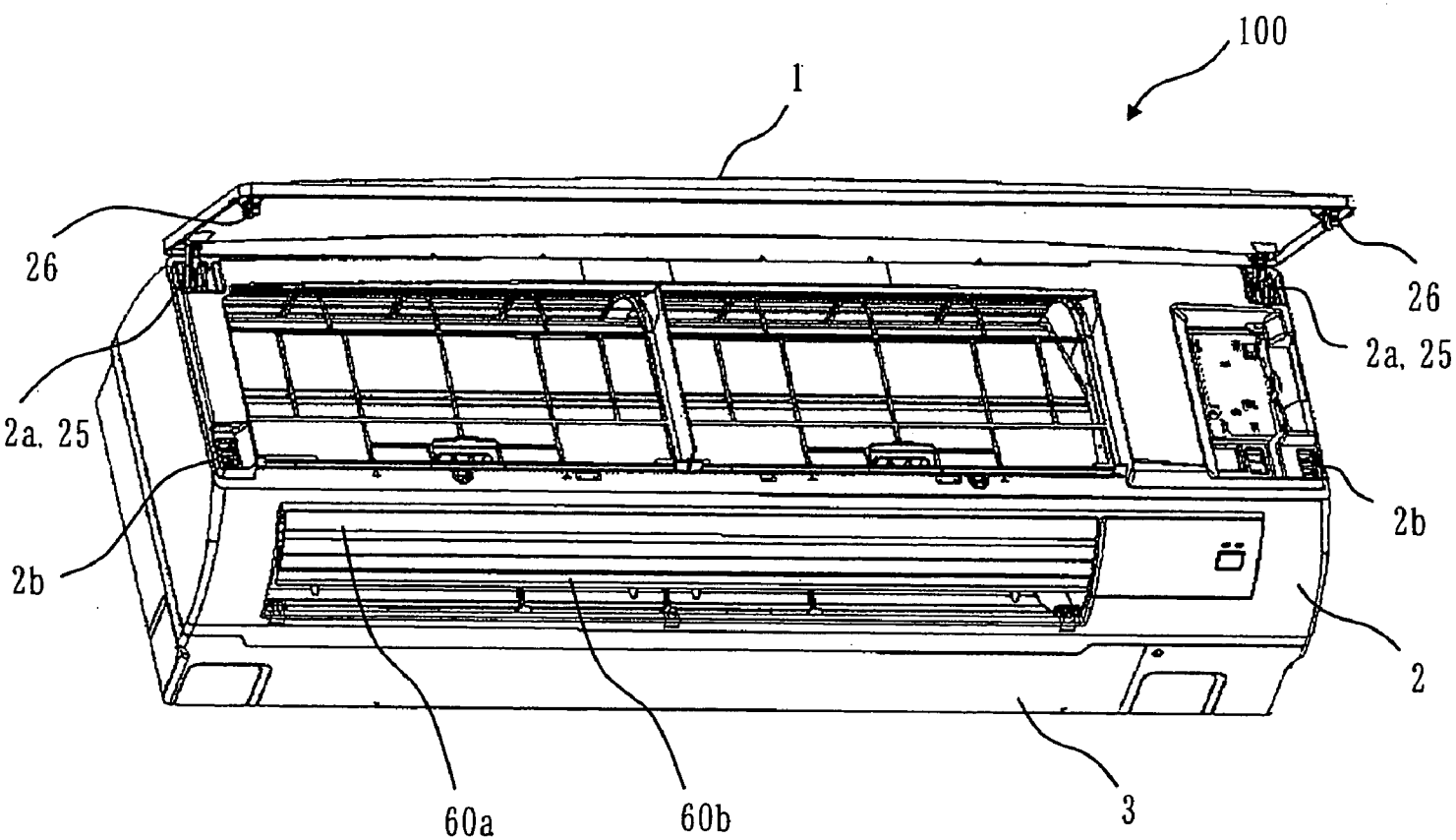
FIG. 1 is a diagram illustrating the first embodiment, and is a perspective view describing an overall structure of an indoor unit 100.
Figure 2:
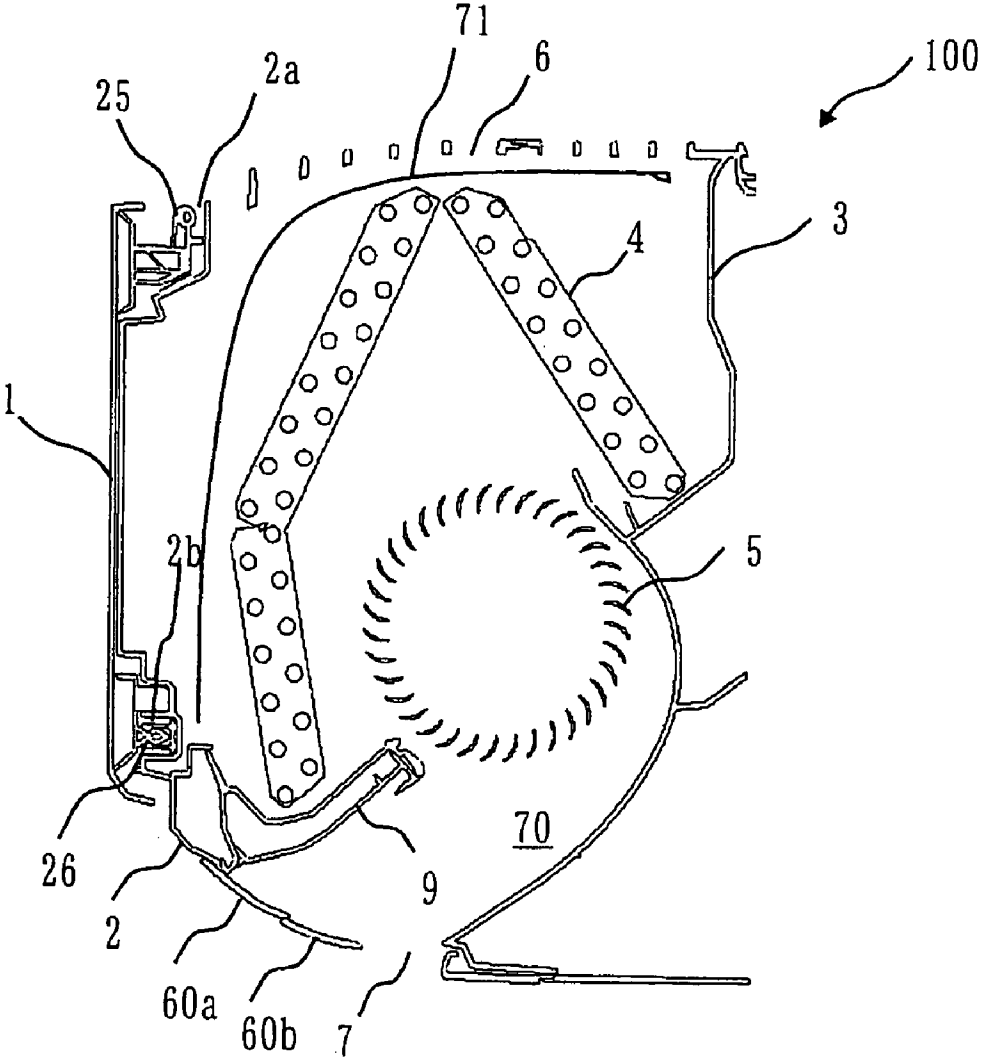
FIG. 2 is a diagram illustrating the first embodiment, and is a vertical cross-sectional view of the indoor unit 100.
Figure 3:
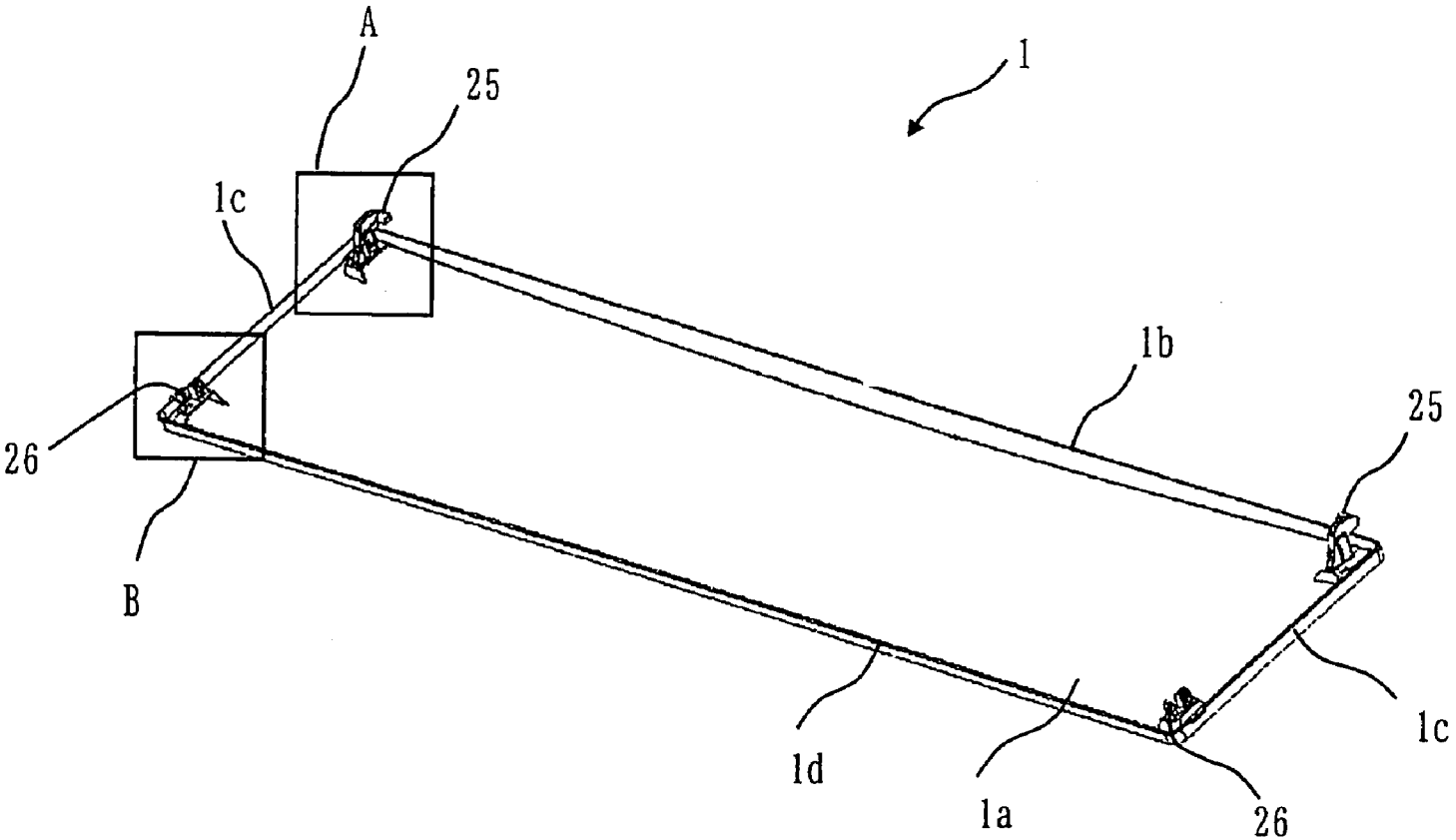
FIG. 3 is a diagram illustrating the first embodiment, and is a perspective view of a front opening and closing panel 1 viewed from a rear side.
Figure 4:
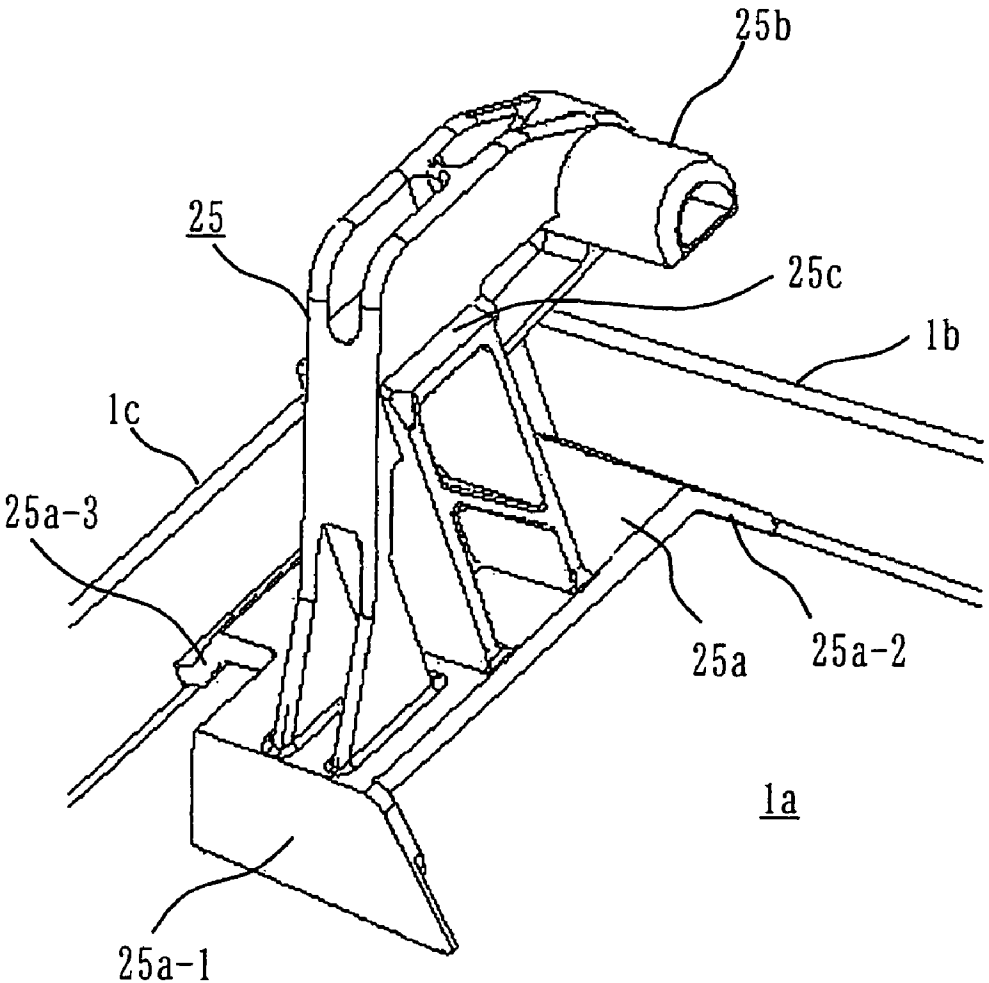
FIG. 4 is a diagram illustrating the first embodiment, and is an enlarged view of part A in FIG. 3.
Figure 5:
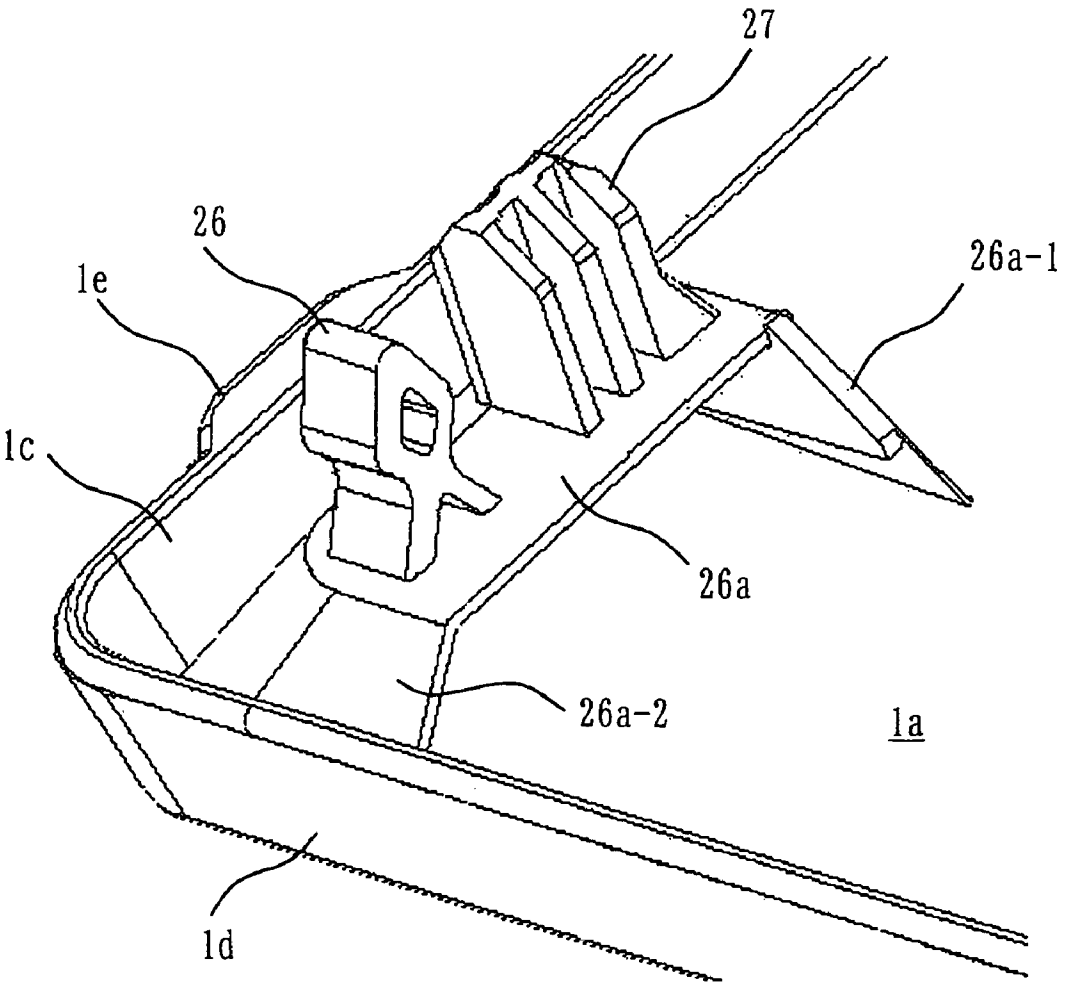
FIG. 5 is a diagram illustrating the first embodiment, and is an enlarged view of part B in FIG. 3.
Figure 6:
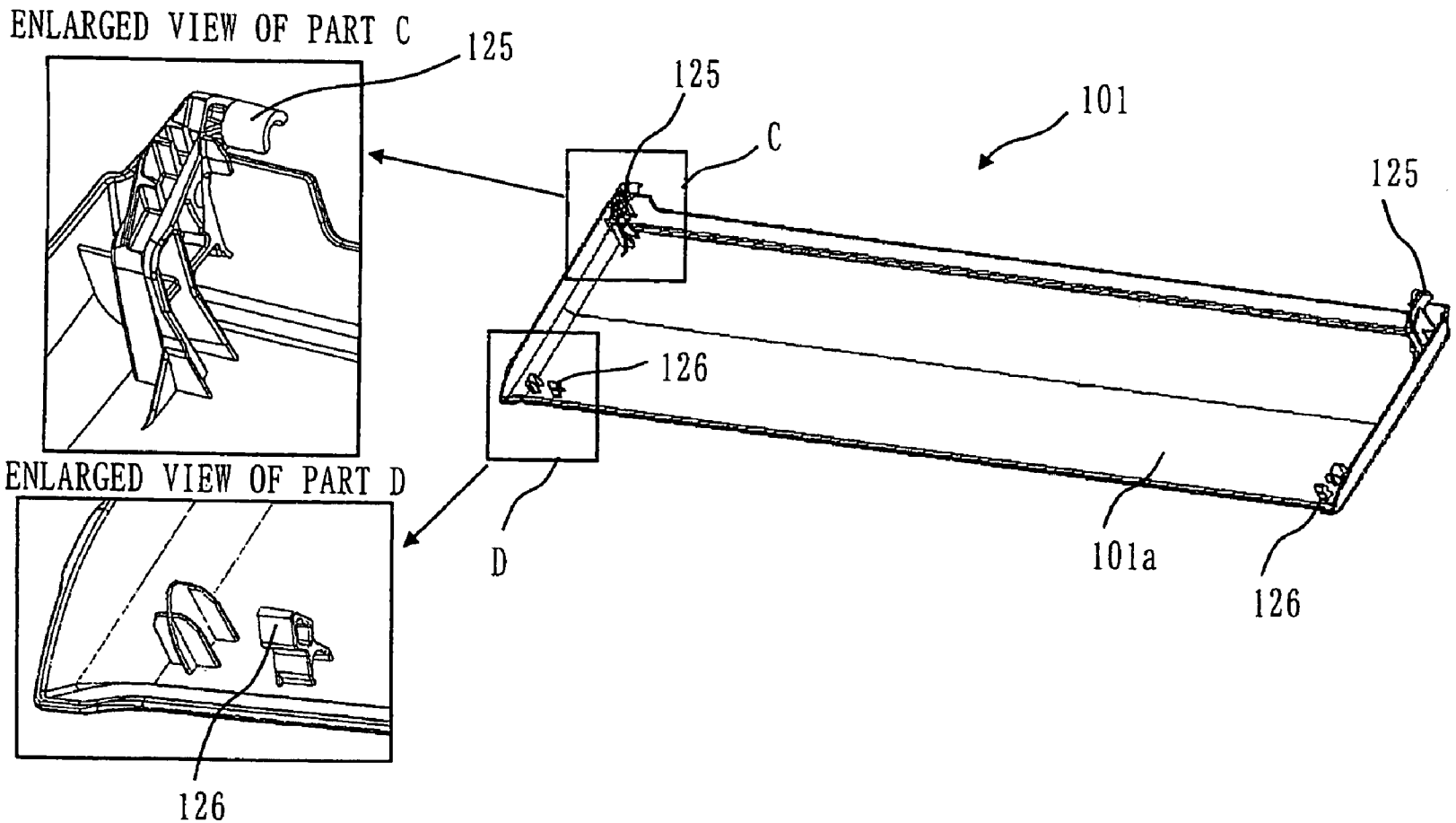
FIG. 6 is a perspective view of a conventional front opening and closing panel 101 viewed from a rear side shown for comparison.
Figure 7:
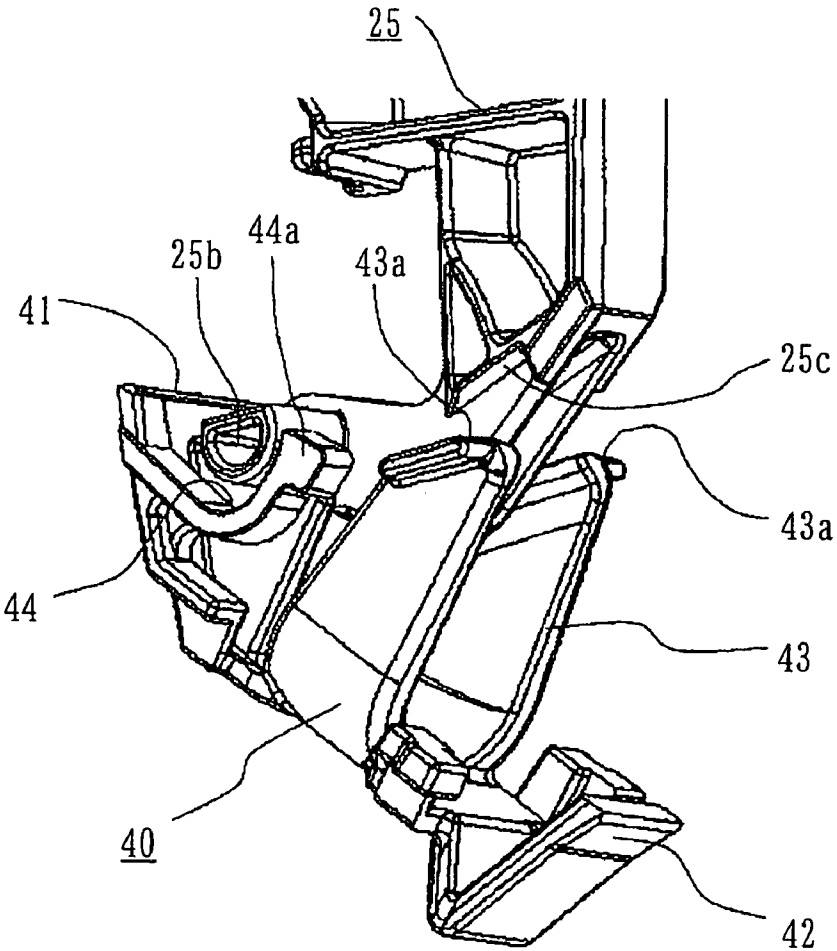
FIG. 7 is a diagram illustrating the first embodiment, and is a perspective view describing a holding means 40 and an arm 25 of the front opening and closing panel 1 in a state attached to or detached from the holding means 40.
Figure 8:
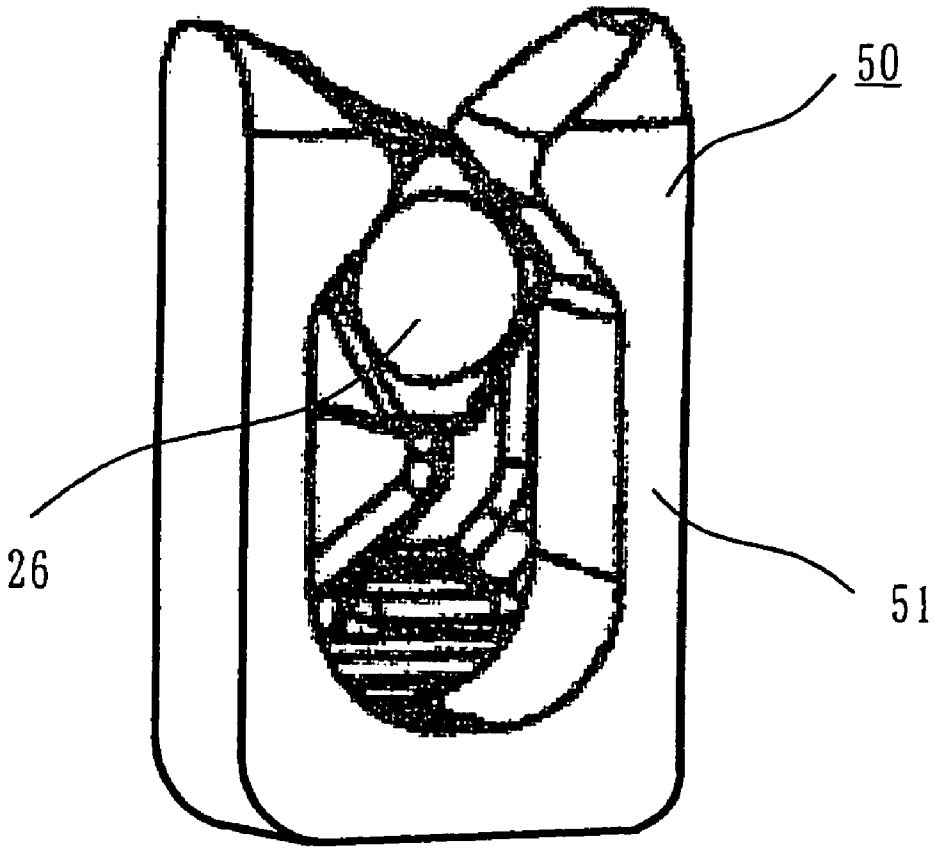
FIG. 8 is a diagram illustrating the first embodiment, and is a perspective view describing relation between a latching means 50 and a lug 26 of the indoor unit 100.

FIG. 1 through FIG. 5, FIG. 7 and FIG. 8 are diagrams describing the first embodiment, where FIG. 1 is a perspective view describing an overall structure of the indoor unit 100, FIG. 2 is a vertical cross-sectional view of the indoor unit 100, FIG. 3 is a perspective view of the front opening and closing panel 1 viewed from the rear side, FIG. 4 is an enlarged view of part A in FIG. 3, FIG. 5 is an enlarged view of part B in FIG. 3, FIG. 7 is a perspective view describing the holding means 40 and the arm 25 of the front opening and closing panel 1 in a state attached to or detached from the holding means 40, and FIG. 8 is a perspective view describing relation between the latching means 50 and the lug 26 fit into the latching means 50. Further, FIG. 6 is a perspective view of a conventional front opening and closing panel 101 viewed from the rear side shown for comparison.

An explanation is provided of the overall structure of the indoor unit 100 of the air conditioner with reference to FIG. 1 and FIG. 2. The present embodiment is characterized by the front opening and closing panel 1. For the other parts, only a brief explanation is provided, since they are the same as in a well-known indoor unit of an air conditioner.

The indoor unit 100 shown in FIG. 1 and FIG. 2 is a wall-hung type indoor unit that can be mounted on a wall inside a room, etc. The air conditioner includes the indoor unit 100, an outdoor unit (not shown), and a remote control (not shown) manipulated by a user inside a room. An explanation of the outdoor unit and the remote control manipulated by the user inside a room is omitted since they are not relevant to the present embodiment.

The main body (housing) of the indoor unit 100 includes a back frame of main body 3 and a front frame of main body 2.

The back frame of main body 3 is located on the rear surface side of the main body of the indoor unit 100. An indoor heat exchanger 4 that exchanges heat of indoor air with a refrigerant in a refrigerating cycle (a refrigerant circuit consisting of the indoor heat exchanger 4 of the indoor unit 100, a compressor of the outdoor unit, an outdoor heat exchanger, a decompression device and a four-way valve, etc.) and an indoor blower 5 (e.c., a line flow fan (TM)) that suctions indoor air into the indoor unit 100 and blows out the air into a room as conditioned air heat-exchanged by the indoor heat exchanger 4 are secured to the back frame of main body 3.

The indoor heat exchanger 4 and the indoor blower 5 are secured to the back frame of main body 3, and project from the back frame of main body 3 toward an indoor side. The projecting parts are housed in the front frame of main body 2. The front frame of main body 2 includes an air inlet 6 in its top surface that suctions indoor air into the indoor unit 100.

The indoor heat exchanger 4 is bent in plural stages (three stages in FIG. 2), and is arranged in such a manner as to cover the front surface, the upper surface and a part of the back surface of the indoor blower 5. An overall shape of the indoor heat exchanger 4 is an approximately inverted V in a side view.

The front opening and closing panel 1 is fixed to the front surface of the front frame of main body 2 in an openable and closable manner in the up-and-down direction taking an upper part (the arms 25 of the front opening and closing panel 1 are held by the holding means (described below) attached to a holding means attached part 2*a* of the front frame of main body 2) of the front frame of main body 2 as a fulcrum. In the front opening and closing panel 1, the lugs 26 engage with the front frame of main body 2 (are latched to a latching means (described below) attached to a latching means attached part 2*b* of the front frame of main body 2) in a closed state, and covers the front surface side of the front frame of main body 2. Then, when the front opening and closing panel 1 is covering the front surface side of the front frame of main body 2, the front surface as a design surface contributes to design of the indoor unit 100.

An air outlet 7 from which conditioned air after being heat-exchanged with the refrigerant in the indoor heat exchanger 4 blows out is formed in a lower part of the front frame of main body 2. The air outlet 7 is so formed as to stretch in a longer direction of the indoor unit 100.

An up-down wind direction board (upper) 60*a* and an up-down wind direction board (lower) 60*b* are provided in upper and lower two stages in the air outlet 7 along a longer direction of the air outlet 7. The up-down wind direction board (upper) 60*a* and the up-down wind direction board (lower) 60*b* adjust vertical (up and down) wind direction of the conditioned air blown out into a room. The up-down wind direction board (upper) 60*a* and the up-down wind direction board (lower) 60*b* are supported their right and left ends in a freely rotating manner, and rotate in an up and down direction by an electric motor (not shown) housed inside the front frame of main body 2 to adjust vertical wind direction of the conditioned air blown out from the air outlet 7 into a room.

When operations of the air conditioner are stopped, the up-down wind direction board (upper) 60*a* and the up-down wind direction board (lower) 60*b* close the air outlet 7 to enhance the design of the indoor unit 100 at the time of stopping operations.

The up-down wind direction board (upper) 60*a* and the up-down wind direction board (lower) 60*b* provided at the exit of the air outlet 7 to change wind direction in a vertical (up and down) direction are made detachable to enable cleaning of an air flow path 70, for example.

A pair of right and left wind direction board assemblies (not shown) are provided in the air outlet 7 at a position near the indoor blower 5, on an upstream side of the up-down wind direction board (upper) 60*a* and the up-down wind direction board (lower) 60*b*. The pair of right and left wind direction board assemblies are so arranged that they are divided into right and left sides at a vicinity of the center of the air outlet 7. Further, each of the pair of right and left wind direction board assemblies has a structure to open forward from the vicinity of the center of the air outlet 7 like double doors when the up-down wind direction board (upper) 60*a* and the up-down wind direction board (lower) 60*b* are detached. The pair of right and left wind direction board assemblies are opened forward to enable cleaning of the air flow path 70, etc.

Each of the right and left wind direction board assemblies includes a right and left wind direction board base, a right and left wind direction board mounted on the right and left wind direction board base in a freely rotating manner, and a fan guard mounted on the right and left wind direction board base in a detachable manner. The fan guard is located on a downstream side (front side) of the right and left wind direction board. The fan guard is provided to prevent the indoor blower 5 from being touched.

The back surface side of the air flow path 70 extending from the indoor blower 5 to the air outlet 7 is formed by the back frame of main body 3. Further, the front surface side of the air flow path 70 is formed by a nozzle 9 fixed to the front frame of main body 2.

The upper surface side of the nozzle 9 on an opposite side of the air flow path 70 is located below the indoor heat exchanger 4. Further, the upper surface side of the nozzle 9 is a drain pan to collect drain water on the surface of the indoor heat exchanger 4. The drain water collected by the drain pan flows through a drain hose, which is not described herein, and is discharged outside of a room.

An air filter 71 for catching dust, etc. mixed in indoor air suctioned from the air inlet 6 is arranged inside the indoor unit 100 between the air inlet 6 and the indoor heat exchanger 4 in such a manner as to cover the indoor heat exchanger 4. The air filter 71 is fixed to the front frame of main body 2 in a detachable manner. Thus, it is possible for users to detach and clean or wash the air filter 71 to prevent clogging by collected dust, etc., and then to fix the air filter 71 again. Users open and close the front opening and closing panel 1 when they attach and detach the air filter 71.

It is also acceptable to provide not only the air filter 71 but also an air cleaning filter to collect fine particles, etc. in indoor air, such as pollens, ticks, mold spores, and tar, etc. with particles smaller than dust, and a deodorizing filter to absorb elements of odors in the suctioned indoor air, and to eliminate odors in the indoor air at the upstream side of the indoor heat exchanger 4. The front opening and closing panel 1 is also opened and closed by users when these air cleaning filter and deodorizing filter are cleaned and washed, or renewed with the new ones.

Next, an explanation is provided of a basic operation of the indoor unit 100. When a user instructs starting operation of the air conditioner by the remote control, etc., the indoor blower 5 in the indoor unit 100 is placed in operation. An electric motor not shown herein is connected to the indoor blower 5. The indoor blower 5 rotates by rotation of the electric motor. Indoor air is suctioned from the air inlet 6 by rotation of the indoor blower 5 and passes through the air filter 71. At this time, dust included in the suctioned indoor air is caught by the air filter 71. The indoor air having passed through the air filter 71 further passes through the indoor heat exchanger 4 by continuous rotation of the indoor blower 5.

The suctioned indoor air is heat-exchanged with the refrigerant in the refrigerating cycle flowing through the indoor heat exchanger 4 when the suctioned indoor air passes through the indoor heat exchanger 4. When the air conditioner is performing cooling operation, the indoor heat exchanger 4 acts as an evaporator, and the refrigerant in the refrigerating cycle is evaporated in the indoor heat exchanger 4 to cool the passing indoor air. When in a case of heating operation, the indoor heat exchanger 4 acts as a condenser to heat the passing indoor air. Thus, the suctioned indoor air is heat-exchanged with the refrigerant flowing through the indoor heat exchanger 4 when the suctioned indoor air passes through the indoor heat exchanger 4 to become conditioned air desired by users. The air filter 71 prevents dust from adhering to the indoor heat exchanger 4 by collecting dust in the suctioned indoor air, and prevents the indoor heat exchanger 4 from lowering heat exchange performance due to adhesion of dust.

The indoor air heat-exchanged with the refrigerant in the indoor heat exchanger 4 becomes conditioned air, which passes through the air flow path 70 by continuous rotation of the indoor blower 5 and which is blown out from the air outlet 7 into a room. When the conditioned air is blown out from the air outlet 7, the up-down wind direction board (upper) 60*a*, the up-down wind direction board (lower) 60*b*, and the right and left wind direction board not shown herein rotate to adjust wind direction of the conditioned air to be blown out. The up-down wind direction board (upper) 60*a*, the up-down wind direction board (lower) 60*b* and the right and left wind direction board not shown herein are rotated respectively by the electric motor incorporated in the indoor unit 100.

Further, by changing the number of rotations of the indoor blower 5, the air volume to be blown out is also adjusted. When a user instructs stopping operations of the air conditioner, the up-down wind direction board (upper) 60*a* and the up-down wind direction board (lower) 60*b* rotate until they cover the air outlet 7 and stop moving while covering the air outlet 7.

Next, an explanation is provided of the front opening and closing panel 1 as a characterizing part of the present embodiment. FIG. 3 is a perspective view of the front opening and closing panel 1 viewed from the back side. The arms 25 to connect the front opening and closing panel 1 with the upper part of the front frame of main body 2 of the indoor unit 100 in an openable and closable manner, and the lugs 26 to retain the front opening and closing panel 1 in a closed state against the front frame of main body 2 of the indoor unit 100 when the front opening and closing panel 1 is closed are disposed upright at the right and left ends of the front opening and closing panel 1.

The front opening and closing panel 1 is as a whole in the form of approximately rectangular shaped plate. The longer direction (right and left direction) of the front opening and closing panel 1 corresponds to the right and left direction of the indoor unit 100. The part in the form of approximately rectangular shaped plate is called as a panel member 1*a*.

A peripheral wall (flange) is formed in a periphery of the panel member 1*a*, which is disposed upright on the rear surface side (the surface to be the front surface side of the main body when the front opening and closing panel 1 is closed, and is on the opposite side of the design surface) of the panel member 1*a*. The peripheral wall to be above when the front opening and closing panel 1 is fixed to the indoor unit 100 is called herein an upper peripheral wall 1*b*. The peripheral walls to be located at the side faces when the front opening and closing panel 1 is fixed to the indoor unit 100 are called herein side peripheral walls 1*b*. There are two side peripheral walls 1*c* on the right and left sides. The peripheral wall to be below when the front opening and closing panel 1 is fixed to the indoor unit 100 is called herein a lower peripheral wall 1*d*.

First, an explanation is provided of the structure of the arm 25 that connects the front opening and closing panel 1 with the upper part of the front frame of main body 2 of the indoor unit 100 in a openable and closable manner by the enlarged view of FIG. 4.

A base 25*a* to mount the arm 25 on is provided on the rear surface of the panel member 1*a* of the front opening and closing panel 1. The base 25*a* is formed spaced-apart (apart for a predetermined distance) from the rear surface of the panel member 1*a*. The base 25*a* includes legs linking to the panel member 1*a*, etc.

A leg 25*a*-1 is formed on the panel member 1*a* approximately parallel to the upper peripheral wall 1*b* and approximately at a right angle to the side peripheral wall 1*c*.

A leg 25*a*-2 is formed in a direction of the upper peripheral wall 1*b*. The leg 25*a*-2 is formed at a slant in a manner to link a corner of the panel member 1*a* and the upper peripheral wall 1*b* with the base 25*a*.

A leg 25*a*-3 is formed in a direction of the side peripheral wall 1*c*. The leg 25*a*-3 is formed at a slant (bent) in a manner to link a corner of the panel member 1*a* and the side peripheral wall 1*c* with the base 25*a*.

The leg 25*a*-1, the leg 25*a*-2 and the leg 25*a*-3 are in a thin-walled rib-like shape small in thickness.

A rotational axis 25*b* held by the holding means (described below) of the holding means attached part 2*a* of the front frame of main body 2 in a freely rotating manner is formed at an apical end (upper part) of the arm 25. The rotational axes 25*b* are formed parallel to the longer direction of the front opening and closing panel 1, and in such a manner that the rotational axes 25*b* on the both ends face each other.

Further, a retaining face 25*c* to retain an opened state of the front opening and closing panel 1 at a predetermined angle is formed in the vicinity of a part of the arm 25 bent in L-shape.

The arm 25 is disposed upright on the base 25*a* that is formed spaced-apart (apart for a predetermined distance) from the rear surface of the panel member 1*a* of the front opening and closing panel 1. The base 25*a* links to the panel member 1*a*, the corner of the panel member 1*a* and the upper peripheral wall 1*b*, or the corner of the panel member 1*a* and the side peripheral wall 1*c* via the thin-walled legs 25*a*-1, 25*a*-2 or 25*a*-3. Thus, a thick rib or a thick boss does not exist on the rear side of the panel member 1*a*, etc. at the time of resin injection molding of the front opening and closing panel 1. Therefore, "sinks" (hollows in a surface of a resin molding product) are difficult to occur in the design surface of the panel member 1*a*. Further, since the legs 25*a*-2 and 25*a*-3 link to the corner of the panel member 1*a* and the upper peripheral wall 1*b*, or the corner of the panel member 1*a* and the side peripheral wall 1*c*, "sinks" are practically unnoticeable even when they are formed.

Next, an explanation is provided of a structure of the lug 26 to retain the front opening and closing panel 1 in a closed state against the front frame of main body 2 of the indoor unit 100 when the front opening and closing panel 1 is closed with reference to the enlarged view of FIG. 5.

A base 26*a* to place the lug 26 on is provided on the rear surface of the panel member 1*a* of the front opening and closing panel 1. The base 26*a* is formed spaced-apart (apart for a predetermined distance) from the rear surface of the panel member 1*a*. The base 26*a* includes legs to link to the panel member 1*a*. Apart from the lug 26, the base 26*a* is also equipped with an insertion guide 27 to guide insertion when the lug 26 is latched to the latching means housed and secured inside the latching means attached part 2*b* of the front frame of main body 2 at the time the front opening and closing panel 1 is being closed. The insertion guide 27 is housed in a concave portion (not shown) of the front frame of main body 2.

A leg 26*a*-1 is formed on the panel member 1*a* approximately parallel to the lower peripheral wall 1*d* and approximately at a right angle to the side peripheral wall 1*c*. The leg 26*a*-1 is tilted.

A leg 25*a*-2 is arranged at a position facing the leg 26*a*-1. The leg 26*a*-2 is formed at a slant in a manner to link a corner of the panel member 1*a* and the lower peripheral wall 1*d* with the base 26*a*.

The leg 26*a*-1 and the leg 26*a*-2 are in a thin-walled rib-like shape small in thickness.

The lug 26 is rhombic in a side view (e.g., when viewed from the side of the side peripheral wall 1*c*).

The lug 26 is disposed upright on the base 26*a* that is formed spaced-apart (apart for a predetermined distance) from the rear surface of the panel member 1*a* of the front opening and closing panel 1. The base 26*a* links to the panel member 1*a*, or the corner of the panel member 1*a* and the lower peripheral wall 1*d* via the thin-walled leg 26*a*-1 or the thin-walled leg 26*a*-2. Thus, a thick rib or a thick boss does not exist on the rear side of the panel member 1*a*, etc. at the time of resin injection molding of the front opening and closing panel 1. Therefore, "sinks" (hollows in a surface of a resin molding product) are difficult to occur in the design surface of the panel member 1*a*. Further, since the leg 26*a*-2 links to the corner of the panel member 1*a* and the lower peripheral wall 1*d*, "sinks" are practically unnoticeable even when they are formed.

FIG. 6 is a perspective view of a conventional front opening and closing panel 101 viewed from the rear side shown for comparison. It has approximately the same structure as the front opening and closing panel 1 shown in FIG. 3 except for a part of the base. In the conventional front opening and closing panel 101, an arm 125 is not equipped with a base. The arm 125 is disposed upright directly from a panel member 101*a* of the front opening and closing panel 101. The same applies to a part of a lug 126.

Thus, a thick rib or a thick boss exists on a rear side of the panel member 101*a*, etc. at the time of resin injection molding of the front opening and closing panel 101. Therefore, "sinks" (hollows in a surface of a resin molding product) are formed in the design surface of the panel member 101*a*.

Next, an explanation is provided of a method for fixing the front opening and closing panel 1 to the front frame of main body 2 of the indoor unit 100 in a freely rotating and detachable manner. As shown in FIG. 1, the holding means attached parts 2*a* concave to the rear (the side of the back frame of main body 3) from the front face of the front frame of main body 2 with sloping grooves at their bottoms are formed in an integrated manner respectively on the both sides of an upper part of the front frame of main body 2. The grooves are sloped in such a direction that their front sides, namely, their front face sides are positioned below and their rear sides are positioned above. The holding means 40 shown in FIG. 7 are respectively fit into the bottom grooves of the holding means attached parts 2*a*. FIG. 7 is a perspective view describing the holding means 40 and the arm 25 of the front opening and closing panel 1 in a state attached to or detached from the holding means 40.

The holding means 40 is integrally formed with self-lubricating resin separately from the front frame of main body 2. An upper latching piece 41 and a lower latching piece 42 of the holding means 40 are respectively fit into both upper and lower end surfaces of the groove formed at the bottom of the holding means attached part 2*a* of the front frame of main body 2, and are fixed to the front frame of main body 2. The lower latching piece 42 positioned below in FIG. 7 is held at the lower end surface of the groove in the holding means attached part 2*a*.

A gap retaining unit 43 in U-shape opening upwardly is formed in an approximately center of the holding means 40. A bearing 44 for supporting the rotational axis 25*b* of the arm 25 in a freely rotating manner, formed approximately in a lower half circle is provided above the holding means 40. The gap retaining unit 43 is slightly narrowed at its upper opening, and the width of the opening is smaller than that of a part where the retaining face 25*c* of the arm 25 is located. Meanwhile, the width between the inner surfaces of the U-shaped gap retaining unit 43 with the exception of the opening is formed larger than that of the part where the retaining face 25*c* of the arm 25 is located.

As described in FIG. 1, the latching means attached parts 2*b* that are concave to the rear (the side of the back frame of main body 3) from the front face of the front frame of main body 2 are formed in an integrated manner respectively on the both sides of a lower part of the front frame of main body 2. The latching means 50 as shown in FIG. 8 are housed and secured inside the latching means attached parts 2*b*. FIG. 8 is a perspective view describing the latching means 50 and the lug 26 fit into the latching means 50 to retain a closed state of the front opening and closing panel 1. The latching means attached parts 2*b* provided on both right and left sides need not be symmetrical with respect to the center of the front frame of main body 2 in the longer direction. The lathing means attached parts 2*b* have only to be suitably set their positions relative to other components housed in the front frame of main body 2, but only in a lower part of the front opening and closing panel 1.

The latching means 50 is integrally formed with self-lubricating resin separately from the front frame of main body 2. A lug enclosing part 51 approximately in U-shape whose opening is at a slant and narrowed is formed approximately at a center of the latching means 50. The latching means 50 is disposed in the latching means attached part 2*b* so that the opening opens forwards from the side of the front frame of main body 2, and the U shape is approximately vertical (approximately at a right angle to the longer direction of the indoor unit 100).

For attaching the front opening and closing panel 1 to the front frame of main body 2 of the indoor unit 100, both sides of a lower part of the front opening and closed panel 1 are first held to orient the front opening and closing panel 1 approximately at a right angle with respect to the front frame of main body 2, then the right and left apical ends of the arms 25 on the both sides are inserted at about the same time into the latching means attached parts 2*b* of the front frame of main body 2, and the rotational axes 25*b* formed at the apical ends of the arms 25 are engaged with the bearings 44 formed in the holding means 40.

Since the bearing 44 has a lower half-circle shape, to be engaged with the bearing 44 means to be put on a surface of an inner periphery of the bearing 44. Here, the reason why the bearing 44 only has a lower half portion is that the bearing 44 has only to support the load in a definite direction of the weight of the front opening and closing panel 1.

As for engagement of the rotational axis 25*b* with the bearing 44, an apical end 44*a* located on the front face of the projecting bearing 44 is elastically deformed and pressed downwards by the rotational axis 25*b*, by pressing the front opening and closing panel 1 to the rear, that is, to the side of the back frame of main body 3, in a position approximately at a right angle to the front frame of main body 2, so that the rotational axis 25*b* goes over the apical end 44*a* of the bearing 44 and is put on the surface of the inner periphery of the bearing 44.

When the rotational axis 25*b* goes over the apical end 44*a*, the elastic deformation is released in the bearing 44. Thus, the bearing 44 is elastically deformed to engage the rotational axis 25*b* with the bearing 44, and the elastic deformation in the bearing 44 is released after engagement. Therefore, a worker installing the front opening and closing panel 1 can feel elastic deformation in the bearing 44 as a response, which enables the worker to determine completion of installation and whether or not the front opening and closing panel 1 is installed correctly from this response.

When engagement of the rotational axes 25*b* with the bearings 44 on the both sides is completed, the front opening and closing panel 1 is moved downwards taking the rotational axes 25*b* as rotation fulcrums to allow the front opening and closing panel 1 to be in a closed state. Then, the retaining faces 25*c* of the arm 25 contact upper end surfaces 43*a* located on the both ends of the opening and the front opening and closing panel 1 stops. This is a state when the front opening and closing panel 1 is retained in an opened state.

When a force is impressed upon the front opening and closing panel 1 to make the front opening and closing panel 1 further rotate downwards, the retaining faces 25*c* on the both sides of the arm 25 cause the U-shaped gap retaining unit 43 to elastically deform outwardly, go over the opening of the gap retaining unit 43, and enter a space between the inner surfaces of the U-shaped gap retaining unit 43. Since the width between the inner surfaces of the gap retaining unit 43 is formed larger than the width of the part where the retaining faces 25*c* of the arm 25 are located, elastic deformation in the gap retaining unit ends when the arm 25 passes through the opening of the gap retaining unit 43 to be placed between the inner surfaces of the gap retaining unit 43.

When the front opening and closing panel 1 continues rotating downwards, the lug 26 contacts the latching means 50 secured to the front frame of main body 2. Then, the rhombic shaped lug 26 broadens tilted and narrowed opening of the lug enclosing part 51 of the latching means 50, that is, elastically deforms the lug enclosing part 51 outward, and enters inside the lug enclosing part 51 to be enclosed therein. When enclosing of the lug 26 in the lug enclosing part 51 is completed, elastic deformation in the lug enclosing part 51 is released. An installation worker can feel that elastic deformation in the lug enclosing part 51 is released as a response, and determine completion of enclosing the lug 26 from the response.

Since the width of the opening of the lug enclosing part 51 is narrower than the width of the lug 26 in a horizontal direction, the lug enclosing part 51 prevents the lug 26 from voluntarily escaping from the opening of the lug enclosing part 51, and prevents uplifting of the lower part of the front opening and closing panel 1. By enclosing the lug 26 in the lug enclosing part 51 and allowing the lug 26 to lodge in the opening of the lug enclosing part 51, the front opening and closing panel 1 is not uplifted, the closed state of the front opening and closing panel 1 is retained stably, the external appearance is improved, and the front opening and closing panel 1 does not get unsteady in a rotational direction taking the rotational axes 25*b* as rotation fulcrums.

Next, an explanation is provided of an opening and closing operation of the front opening and closing panel 1 by users. Users open and close the front opening and closing panel 1 of the indoor unit 100 installed at a wall in a room in order to clean, etc. the air filter 71, or clean the indoor unit 100, as described above. When users open the front opening and closing panel 1, the users first place fingers on handy-grip parts 1*e* (refer to FIG. 5) on the both sides of the front opening and closing panel 1, and extract the right and left lugs 26 from the lug enclosing parts 51 in the latching means 50 by pulling the handy-grip parts 1*e* forward (toward their own sides) at the time the indoor unit 100 is stopping operations.

As shown above, according to the present embodiment, the arms 25 (held by the holding means 40 attached to the holding means attached parts 2*a* in the front frame of main body 2) and the lugs 26 (latched to the latching means 50 attached to the latching means attached parts 2*b* in the front frame of main body 2) provided on the rear surface on the opposite side of the design surface of the front opening and closing panel 1 that is mounted on the front face of the front frame of main body 2 in an openable and closable manner in a vertical direction are disposed upright on the bases 25*a* and the bases 26*a* respectively, which are formed spaced-apart (apart for a predetermined distance) from the rear surface of the panel member 1*a*. Further, the bases 25*a* and the bases 26*a* have such structures that the bases 25*a* and the bases 26*a* link to the panel member 1*a* or the peripheral walls of the front opening and closing panel 1 via thin-walled legs. Thus, a thick rib or a thick boss does not exist on the rear side of the panel member 1*a*, etc. at the time of resin injection molding of the front opening and closing panel 1. Therefore, "sinks" (hollows in a surface of a resin molding product) are difficult to occur in the design surface of the panel member 1*a*. Further, since the legs link to the corners of the panel member 1*a* and the peripheral walls, "sinks" are practically unnoticeable even when they are formed.

The indoor unit of the air conditioner according to the present invention includes the base, whereon the arm or the lug is disposed upright, provided on the rear surface of the front opening and closing panel in a manner spaced apart from the front opening and closing panel, and the thin-walled leg for connecting the front opening and closing panel with the base.

Having thus described several particular embodiments of the present invention, various alterations, modifications, and improvements will readily occur to those skilled in the art. Such alterations, modifications, and improvements are intended to be part of this disclosure, and are intended to be within the spirit and scope of the present invention. Accord-ingly, the foregoing description is by way of example only, and is not intended to be limiting. The present invention is limited only as defined in the following claims and the equivalents thereto.

What is claimed is:

1. An indoor unit of an air conditioner, the indoor unit of the air conditioner being a wall-hung type indoor unit, comprising:

a main body including a front frame and a back frame;

a front opening and closing panel that is mounted on the front frame in a freely openable and closable manner and that includes a front surface and a rear surface;

at least one thin-walled first leg provided on and extending from the rear surface of the front opening and closing panel;

a first base disposed on the at least one thin-walled first leg, therefore being spaced apart from the front opening and closing panel;

an arm that is disposed on the first base and held in a freely rotating manner at the front frame of the main body;

at least one thin-walled second leg provided on and extending from the rear surface of the front opening and closing panel;

a second base separate from the first base and disposed on the at least one thin-walled second leg, therefore being spaced apart from the front opening and closing panel; and a lug that is disposed on the second base and latched to the front frame of the main body when the front opening and closing panel is in a closed state, wherein the at least one thin-walled first leg and the at least one thin-walled second leg are configured and positioned on the rear surface of the front opening and closing panel so that the front surface of the front opening and closing panel has a sink-free appearance.

2. The indoor unit of the air conditioner as defined in claim 1, wherein the front opening and closing panel includes a peripheral wall that is disposed upright from a peripheral part of the front opening and closing panel, and a portion of each of the thin-walled first leg and the thin-walled second leg is linked to a corner where the rear surface of the opening and closing panel and the peripheral wall intersect.

3. The indoor unit of the air conditioner as defined in claim 1, wherein the at least one thin-walled first leg comprises a plurality of thin-walled first legs provided on and extending from the rear surface of the front opening and closing panel, the at least one thin-walled second leg comprises a plurality of thin-walled second legs provided on and extending from the rear surface of the front opening and closing panel, the first base is disposed on the plurality of thin-walled first legs and is therefore spaced apart from the front opening and closing panel, and the second base is disposed on the plurality of thin-walled second legs and is therefore spaced apart from the front opening and closing panel.

4. The indoor unit of the air conditioner as defined in claim 3, wherein the front opening and closing panel includes peripheral walls that rearwardly extend from the rear surface thereof, and at least one of the plurality of thin-walled first legs and at least one of the plurality of thin-walled second legs rearwardly extends from an intersection of one of the peripheral walls and the rear surface of the front opening and closing panel.

5. The indoor unit of the air conditioner as defined in claim 4, wherein the intersection of one of the peripheral walls and the rear surface of the front opening and closing panel corresponds to an unnoticeable location on the front surface of the opening and closing panel.

6. The indoor unit of the air conditioner as defined in claim 3, wherein the first base and the second base are respectively disposed on the plurality of thin-walled first legs and the plurality of thin-walled second legs substantially parallel to the rear surface of the opening and closing panel.

7. The indoor unit of the air conditioner as defined in claim 1, wherein the first base and the second base are respectively disposed on the at least one thin-walled first leg and the at least one thin-walled second leg substantially parallel to the rear surface of the opening and closing panel.

8. An integrally molded opening and closing panel for an air conditioner main body, comprising:

a panel member including a front surface and a rear surface;

a side peripheral wall that rearwardly extends from the rear surface;

an upper peripheral wall that also rearwardly extends from the rear surface;

a first thin-walled leg extending from an intersection of the upper peripheral wall and the panel member;

a second thin-walled leg extending from the panel member and that is spaced apart from the first thin-walled leg;

a base disposed on the first and second thin-walled legs in spaced-apart relation with the panel member; and an arm that is disposed on the base and that is configured to connect the panel member to the air conditioner main body in a freely rotating manner, wherein the first and second thin-walled legs are configured and positioned to minimize an appearance of sinks on the front surface of the panel member.

9. The integrally molded opening and closing panel as recited in claim 8, further comprising a third thin-walled leg extending from an intersection of the side peripheral wall and the panel member and on which the base is also disposed, the third thin-walled leg also configured and positioned to minimize the appearance of sinks on the front surface of the panel member.

10. The integrally molded opening and closing panel as recited in claim 8, wherein the intersection from which the first thin-walled leg extends corresponds to an unnoticeable location on the front surface of the panel member.

11. The integrally molded opening and closing panel as recited in claim 9, wherein the intersection from which the third thin-walled leg extends corresponds to another unnoticeable location on the front surface of the panel member.

12. The integrally molded opening and closing panel as recited in claim 8, wherein the base is disposed on the first and second thin-walled legs substantially parallel to the rear surface of the panel member.

13. An integrally molded opening and closing panel for an air conditioner main body, comprising:

a panel member including a front surface and a rear surface;

a side peripheral wall that rearwardly extends from the rear surface;

a lower peripheral wall that also rearwardly extends from the rear surface;

a first thin-walled leg extending from an intersection of the lower peripheral wall and the panel member;

a second thin-walled leg extending from the panel member and that is spaced apart from the first thin-walled member;

a base disposed on the first and second thin-walled legs in spaced-apart relation with the panel member; and a lug that is disposed on the base and that is configured to latch to the air conditioner main body, wherein the first and second thin-walled legs are configured and positioned to minimize an appearance of sinks on the front surface of the panel member.

14. The integrally molded opening and closing panel as recited in claim 13, wherein the intersection from which the first thin-walled leg extends corresponds to an unnoticeable location on the front surface of the panel member.

15. The integrally molded opening and closing panel as recited in claim 13, wherein the base is disposed on the first and second thin-walled legs substantially parallel to the rear surface of the panel member.

16. An indoor unit of an air conditioner, the indoor unit of the air conditioner being a wall-hung type indoor unit, comprising:

a main body including a front frame of a main body and a back frame of a main body;

a front opening and closing panel that is mounted on the front frame of the main body in a freely openable and closable manner;

an arm that is provided on a rear surface of the front opening and closing panel, and held in a freely rotating manner at the front frame of the main body;

a lug that is provided on the rear surface of the front opening and closing panel, and latched to the front frame of the main body when the front opening and closing panel is in a closed state;

a base, whereon the arm or the lug is disposed upright, that is provided on the rear surface of the front opening and closing panel in a manner spaced apart from the front opening and closing panel; and a leg that links the front opening and closing panel with the base, wherein the front opening and closing panel includes a panel member whereof a front side is a design surface, and a peripheral wall that is disposed upright on a rear side of a peripheral part of the panel member, the leg is formed at a slant to a rear surface of the panel member, and a part of the leg is linked to a corner where the panel member and the peripheral wall intersect.

17. The indoor unit of the air conditioner as defined in claim 16, wherein the leg curves to link to the corner.

18. The indoor unit of the air conditioner as defined in claim 16, wherein the panel member is approximately rectangular in shape, the base is provided in an upper portion or a lower portion of right and left ends of the panel member, the peripheral wall includes an upper side peripheral wall, a lower side peripheral wall, a left peripheral wall and a right peripheral wall corresponding to four sides of a periphery of the panel member approximately rectangular in shape, and the leg includes a first leg that is linked to a corner where either of the upper side peripheral wall or the lower side peripheral wall and the panel member intersect, and a second leg that is linked to a corner where either of the left peripheral wall or the right peripheral wall and the panel member intersect.

* * * * *